United States Patent [19]

Bear

[11] Patent Number: 5,011,120

[45] Date of Patent: Apr. 30, 1991

[54] METAL CASTING LADLE

[75] Inventor: Philip N. Bear, Rosemount, Minn.

[73] Assignee: Versa Companies, Minneapolis, Minn.

[21] Appl. No.: 416,268

[22] Filed: Oct. 2, 1989

[51] Int. Cl.[5] ..... B22D 41/06

[52] U.S. Cl. ..... 266/240; 266/275

[58] Field of Search ..... 266/275, 240, 242, 276; 432/263, 262; 222/604, 605, 629; D15/135

[56] References Cited

U.S. PATENT DOCUMENTS

| | | | |
|---|---|---|---|
| 280,627 | 9/1885 | Uram et al. | D15/135 |
| 2,650,255 | 8/1953 | Hogël et al. | 266/240 |
| 2,806,264 | 9/1957 | Keating | 222/629 |
| 4,022,359 | 5/1977 | Smidt | 222/629 |
| 4,074,837 | 2/1978 | Engel | 222/629 |
| 4,078,707 | 3/1978 | Ishikawa | 222/629 |
| 4,286,678 | 9/1981 | Scheureket et al. | 222/607 |
| 4,353,406 | 10/1982 | Gaddi | 222/629 |

*Primary Examiner*—S. Kastler

*Attorney, Agent, or Firm*—Harold D. Jastram; Robert A. Elwell

[57] ABSTRACT

A metal casting ladle utilized for pouring molten metal and having mounting blocks located on each side of a pour spout and used for independent and alternate attachments of the ladle to either a left mount or a right mount casting machine to permit pouring molten metal from the ladle on an axis falling through the lip of the spout.

7 Claims, 4 Drawing Sheets

METAL CASTING LADLE

BACKGROUND OF THE INVENTION

This invention relates to a metal casting ladle utilized for casting hot metals, particularly non-ferrous metals such as aluminum and the like. Ladles designed for accommodating casting are well known in the art and have been well developed so that a variety of ladles have been developed for the purpose of addressing specific operating and handling conditions in the art. A problem of particular concern to the industry involved in casting aluminum parts is the corrosive nature of the process.

Ladles made of cast iron and other ferrous metals are commonly used in this industry. Unfortunately, the corrosive nature of the process causes the metal of the ladle to be attacked when exposed to the molten aluminum. In effect, a small amount of the metal from the ladle goes into solution with the molten aluminum. This results over time with a continuous erosion of the metal forming the ladle with the result that ladles need to be replaced on a relatively frequent basis.

A wide variety of manufacturers of metal casting machines also provide a variety of techniques for handling the ladle. Problems which must be solved in the handling of these molten aluminum products involves the proper pouring of the molten aluminum from the ladle as well as filling the ladle with the prescribed quantity of the molten metal. Careful control must be maintained during the handling of the molten aluminum in order to insure that proper casting temperatures are maintained in the transportation of the molten aluminum from the source to the casting mold.

Since there are many manufacturers of machines for handling molten aluminum products, there are likewise many varieties of mechanical arms, transfer booms and similar apparatus adapted to carry the ladle filled with molten aluminum between the source of the molten aluminum and the casting mold. As an example, manufacturers attempt to pour the molten aluminum from the ladle in a controlled fashion. Some manufacturers attempt to carry the ladle in a fashion so that the open top of the ladle is always horizontal.

Other manufacturers solve problems of raising and lowering the filled ladle by a series of sophisticated linkages and pivots in order to insure that spillage and similar accidents will not occur. These transfer machines must be provided with sufficient mobility and operating power in order to direct the ladle over the casting mold without engaging the casting mold or otherwise destroying the mold in the transfer process.

Further, careful control of the rate of flow of the molten metal from the ladle in order to insure high quality moldings constant flow is very important.

As many of these transfer and handling problems have been solved by the various manufacturers, the machine manufacturers have designed machines which employ ladles which may be attached to the machines in a variety of ways. Some machines are designed so that the ladle has a left-hand attachment only. Other machines of the same or other manufacturers are designed to have right-hand attachments to the metal casting ladle. Yet other manufacturers employ ladles which must be mounted with a yoke-type mechanism. The result of these various design adaptations has resulted in a complex and troublesome inventory and use problem for metal casters. The various ways of mounting the casting ladle has required that metal casters maintain a large inventory of ladles designed for a variety of machines employing either left or right-hand attachment of the ladle to the machine.

An additional inventory problem is created by the need to employ ladles having different physical capacities from a few ounces to over twenty pounds of metal. Therefore there is a significant cost incentive for metal castors to reduce the total inventory of ladles necessary to meet the devised casting needs of the various casting needs encountered by a business. This can be achieved by employing a ladle that is adaptable to a wide variety of left and right mount machines and capable of accommodating a variety of mounting brackets.

U.S. Pat. No. 4078707 is a good example illustrating the use of a series of levers and pivots adapted to carry molten metal to a mold where the metal is then poured from the ladle by simply tipping the ladle employing the pivot and lever type arrangements.

Likewise, U.S. Pat. No. 4074837 illustrates a machine employing a series of parallel arms and pivots for the purpose of moving a ladle from a source of molten metal to a casting mold where the metal is deposited from the ladle. Again, it is noted that the device illustrates a complex series of arms which are attached to the ladle for this purpose.

Likewise, U.S. Pat. No. 4353406 also illustrates a machine employing a casting ladle mounted rotatably on a movable support member which conveys a ladle between a filling station and at least one casting station. In this device, the inventor has placed the ladle at the end of an endless chain for manipulating the ladle. The inventor in this patent suggests a device which has a movable support member on which a ladle is mounted for rotation about a horizontal axis which passes substantially through the casting spout. The inventor, however, fails to disclose the mechanisms and the method whereby that is accomplished.

SUMMARY OF THE INVENTION

It is accordingly an object of this invention to provide a metal casting ladle specifically designed to pour molten metals.

It is another object of the present invention to provide a metal casting ladle employing left and right hand mounts for permitting the casting ladle to be mounted on casting machines requiring either left- or right-hand mounts.

A further object of the present invention is to provide a metal casting ladle employing a pour-spout having a lip where the metal is poured from the ladle coincidental with the axis of a mounting shaft to permit the casting ladle to permit precise control of the discharge of molten metal from the ladle.

Another object of the present invention is to provide a metal casting ladle designed to employ a lip of a pouring spout which lies on a pouring axis of a mounting system utilized to control the discharge of metal from the ladle, and further, in which the spout terminates at the axes of the means for controlling the ladle.

It is an advantage of the present invention that it employs mounting means on either side of a pouring spout so that the ladle may be attached to casting machines requiring either left or right-hand mounts. The particular advantage of the casting ladle also includes this left and right mount adaptability while maintaining the pour axes of the ladle at the same location falling through the lip of the pour-spout on the ladle.

Other objects and features of the present invention will become apparent from the following description of preferred embodiments of the present invention with reference to the drawings.

DETAILED DESCRIPTION OF THE INVENTION

Figure 1:
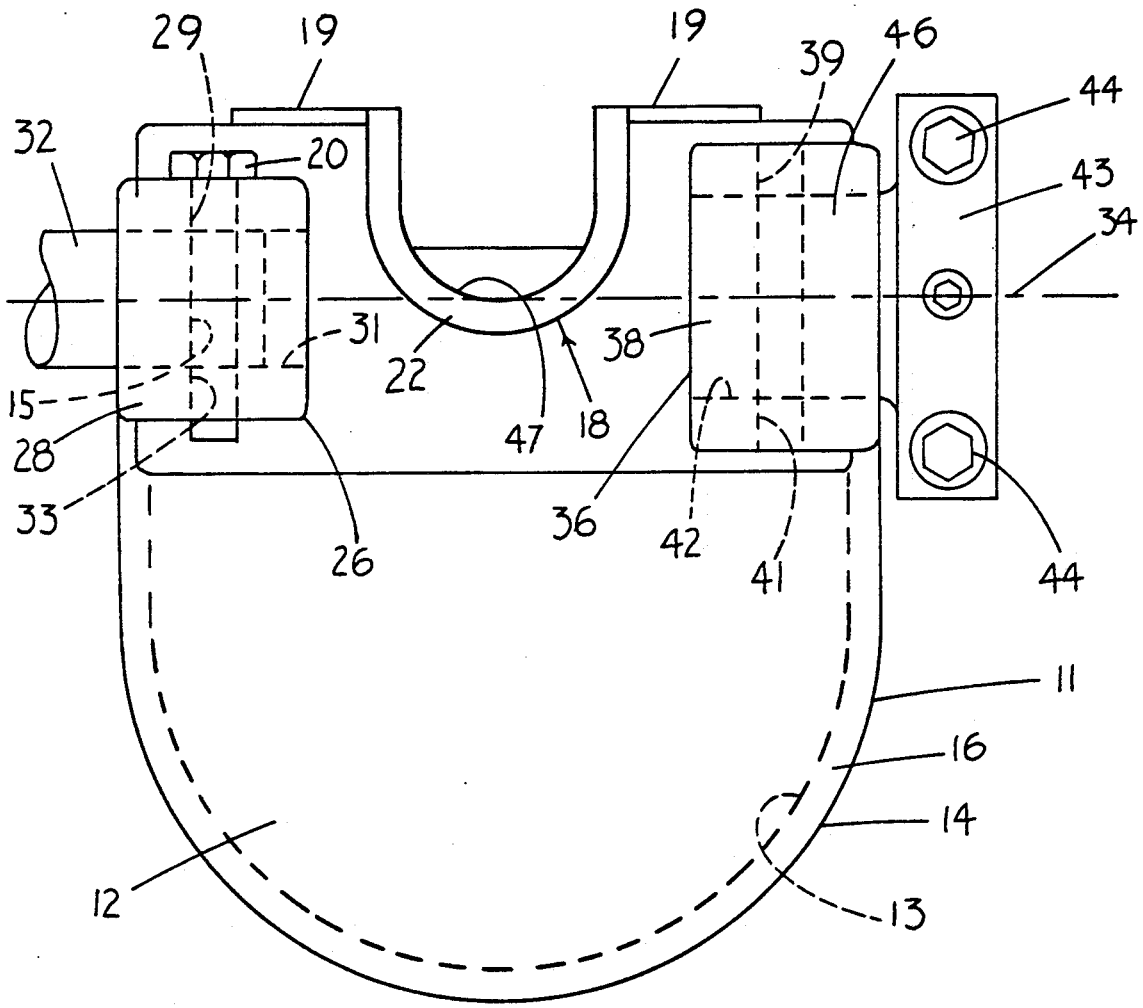
FIG. 1 is a front elevation view of the present invention illustrating left and right mounting blocks.

Refer first to FIG. 1 of the drawings which illustrates a metal casting ladle in front elevational view and generally designated by the numeral 11. The ladle 11 has a bowl 12 which has an inside surface and an outside surface, 13 and 14 respectively. The wall 16 of bowl 12 can be of a variety of shapes but is commonly made of a cast iron material and uniformly shaped to provide a bowl 12 for carrying molten aluminum. The shape of the bowl 12 can be observed by reference to FIGS. 2 and 4 of the drawings which illustrate the generally rounded characteristics of the bowl. It is not necessary, however, for the purposes of this invention that the bowl 12 be in this particular shape or relative size.

The wall 16 of bowl 12 terminates at a top rim 17. This provides the opening for the ladle 11 so that molten aluminum or other metal may be introduced into the bowl 12 through the opening formed by top rim 17. It is particularly noted that ladle 11 is shaped so that there is no obstruction over the opening to the ladle 11. Nearly the entire surface of top rim 17 lies in a single plane. It is noted, however, by reference to FIG. 2 of the drawings that the spout 18 is formed at one end or one side of the ladle 11. A preferred method for forming spout 18 is to extend one portion of the rim 17 to a higher plane to form an upper rim 19 which essentially forms the top of the spout. This provides for control of molten aluminum as the aluminum is poured from the bowl 12 through the spout into a casting mold. A front view of the spout can be more readily viewed in FIG. 1 of the drawings where the spout 18 is shown with a U-shaped cross-sectional area. A U-shaped cross-sectional spout 18 is employed however, other shapes are equally adaptable and usable for this particular ladle.

Figure 3:
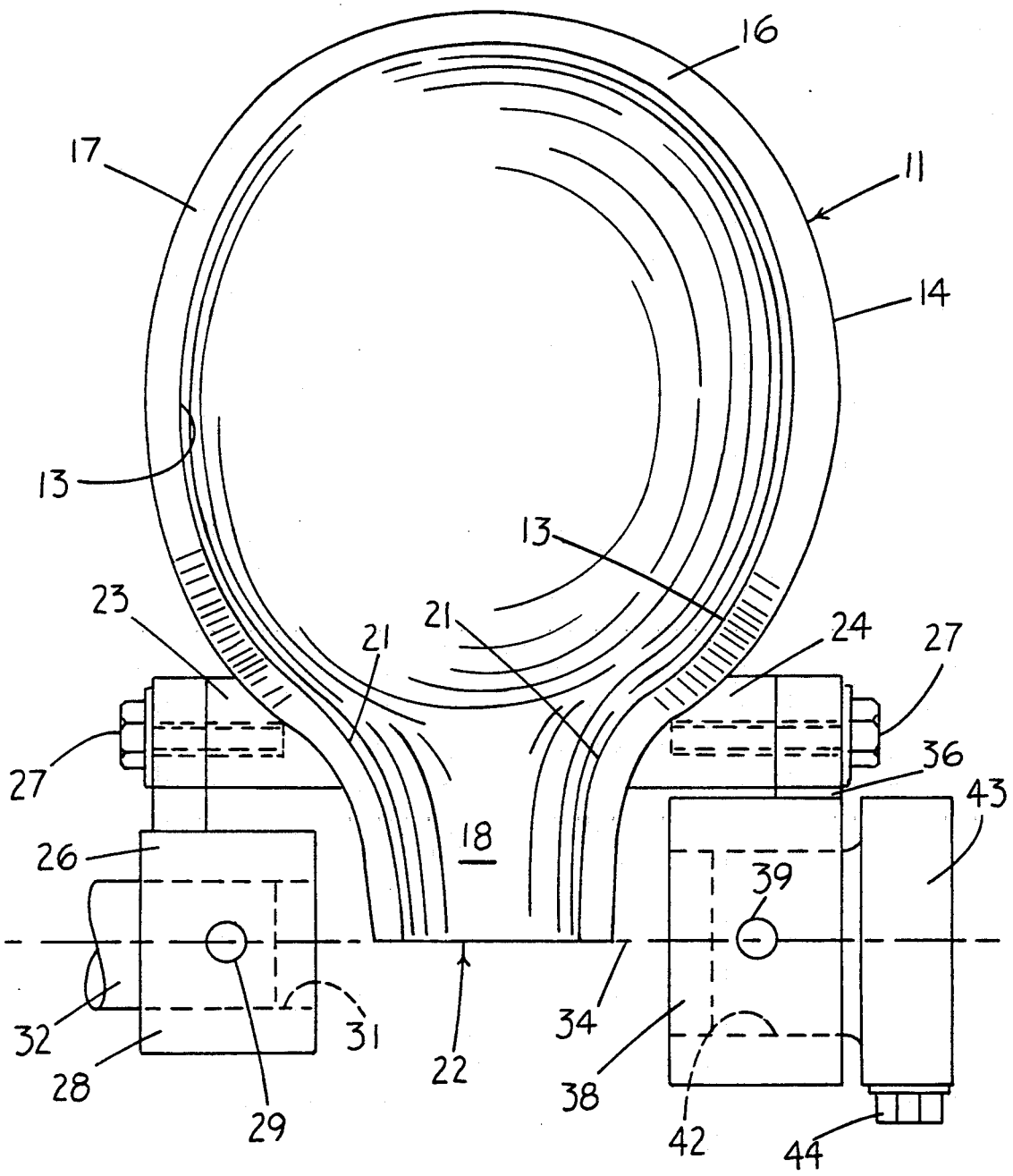
FIG. 3 is a top plan view of a metal casting ladle according to the present invention, illustrating left and right mounting blocks.

FIG. 3 of the drawings will illustrate that the inside surface 13 of the bowl 12 is provided with a uniform and curved transition area 21 where the inside wall 13 of the wall 16 is gradually redirected to merge with the spout 18 so that molten metal contained within the ladle 11 will flow smoothly along the inside surface 13 of the spout 18 and exit the spout at lip 22. The transition area 21 provides a uniformly smooth surface for directing the molten metal into the spout 18 to avoid splashing or turbulence in the molten metal as it exits the bowl 12 through spout 18. Splashing and turbulence is to be avoided because it results in excessive and rapid oxidation of hot reactive metals such as molten aluminum. Splashing also causes oxide entrapment in the molten metal which will produce poor or unusable castings.

An important feature of the invention is illustrated in FIG. 1 of the drawings in which a left mounting block 23 is mounted on the left side of spout 18 and in the location of the transition zone 21 on the left-hand side of the bowl 12 as illustrated in FIG. 1 of the drawings An identical right-hand mounting block 24 is also mounted on the right side of the ladle 11 again, in the transition zone 21 of the wall 16. These mounting blocks 23 and 24 are located near the spout 18 and on either side of the spout to provide for mounting the ladle 11 either on a left-hand or a right-hand mounted metal casting machine. A preferred method of mounting the ladle 11 to a machine employs a left mounting bracket 26 which is attached to the left mounting block 23 by a bolt 27. Left bracket 26 has a left journal housing 28 with a pin aperture 29 to the housing.

The ladle 11 will normally function with the ladle 11 attached to a casting machine by a bracket attached on only one side of the ladle. When the ladle 11 is mounted, the ladle 11 will not have a bracket on the opposite side.

Figure 4:
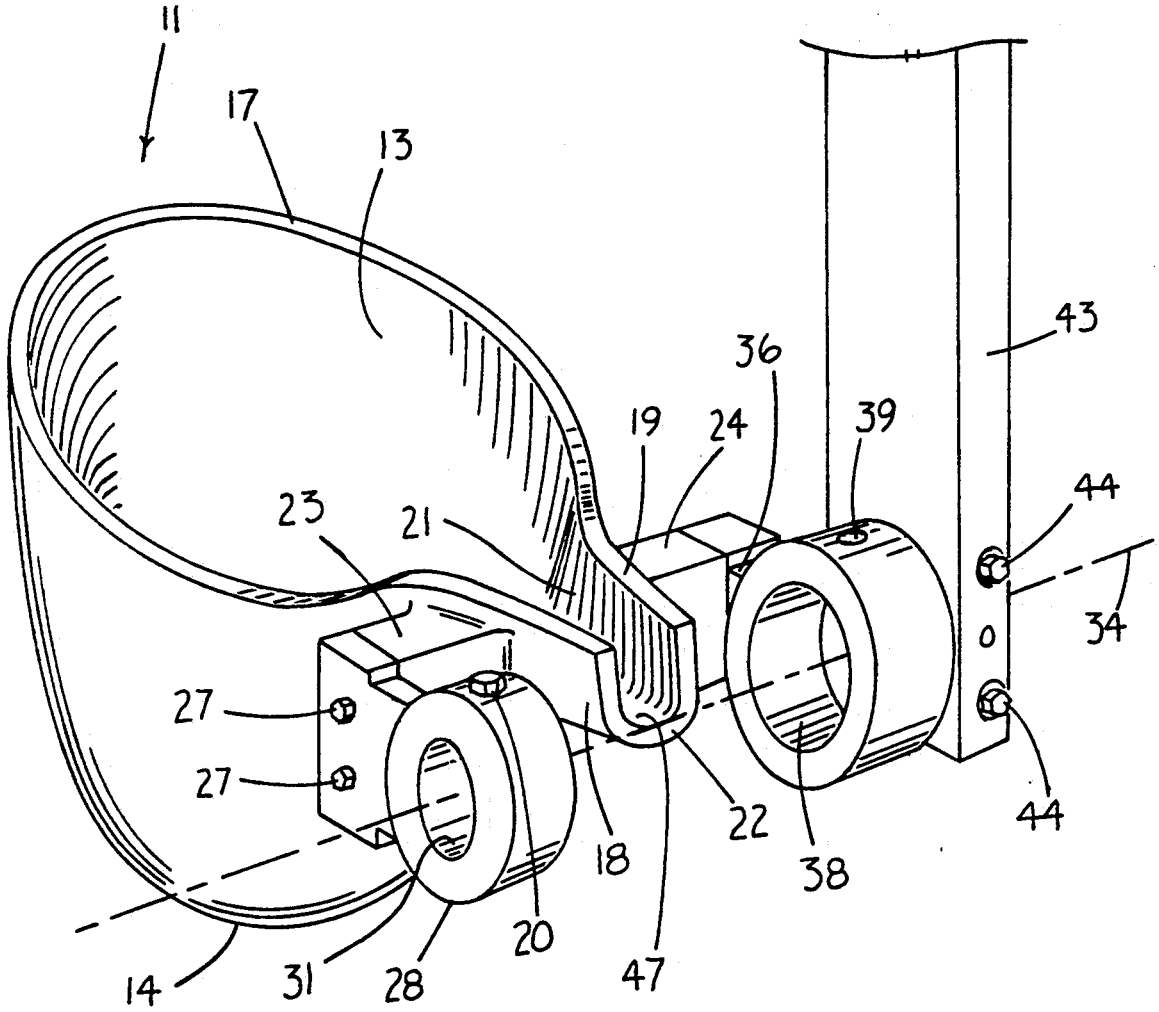
FIG. 4 is an isometric view of a metal casting ladle according to the present invention.

Reference to FIG. 4 of the drawings will reveal that the housing 28 in this embodiment contains a longitudinal opening 31 which extends entirely through the left journal housing and is adapted to accommodate a shaft 32 as illustrated in FIG. 1. Shaft 32 is merely any shaft or device employed in the casting machine which is adapted to connect the ladle to the bracket 26 and consequently to attache the ladle to the casting machine. In this particular embodiment illustrated in connection with the left mounting bracket 26, a shaft 32 extends into the opening 31 and is aligned with a pin aperture 29. The shaft 32 would also need to have a pin channel 15 for receiving the pin 20 engaged in aperture 29 so that the pin extends entirely through the journal housing 28 and through the pin channel 15 in shaft 32 and then also engages a second pin aperture 33 best illustrated in FIG. 1 of the drawings. In this way, a drive shaft 32 designed to control the ladle 11 attaches the ladle and left bracket to a metal casting machine. The apertures 29 and 33 are aligned on the same axis or pin axis which is perpendicular to a pour axis 34. The function of the pour axis will be more fully explained hereinafter.

Figure 2:
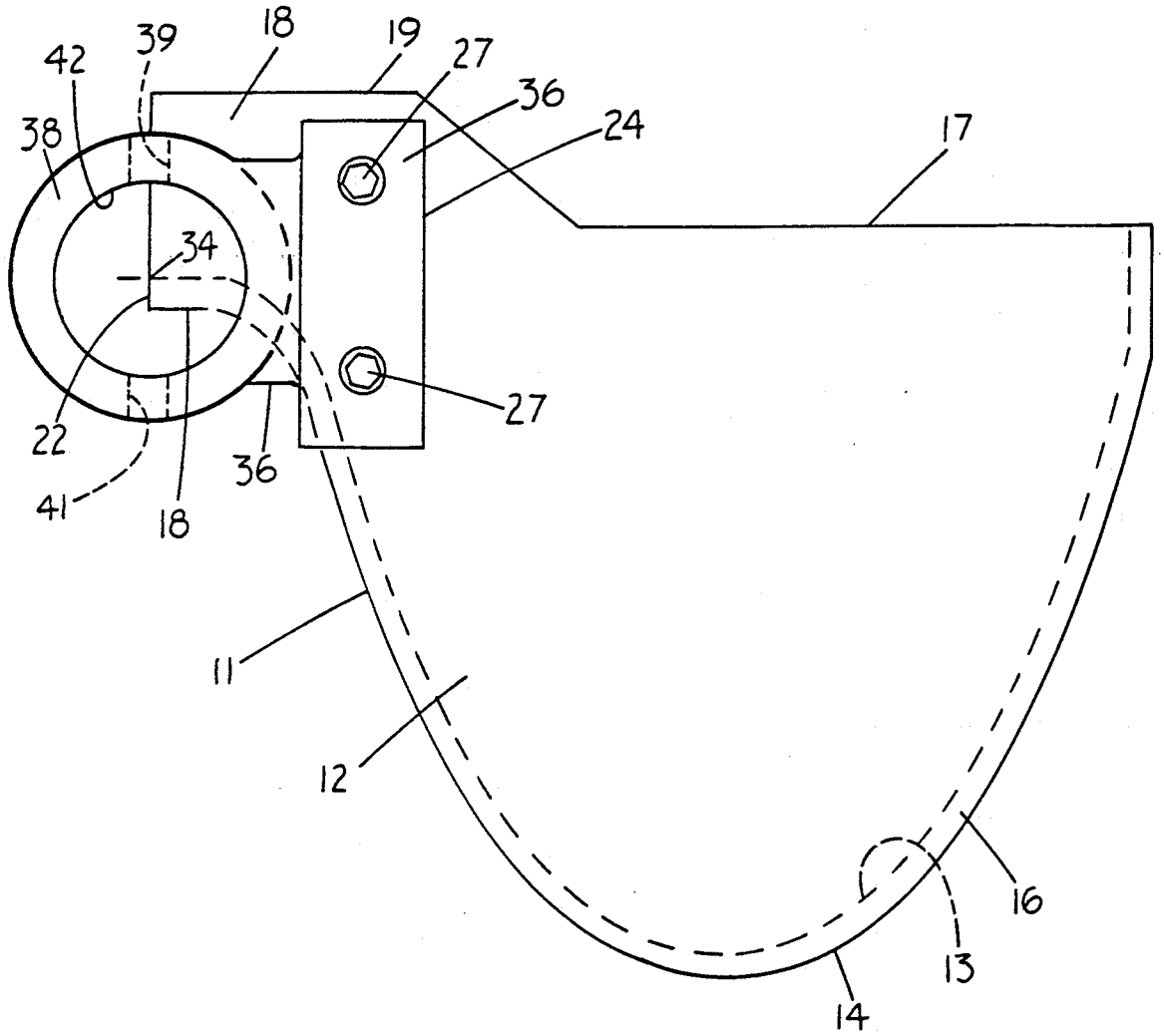
FIG. 2 is a right-side elevation view as viewed in FIG. 1 of the drawings, illustrating the right mounting block.

The left bracket 26 may be identical to right bracket 36 which is illustrated in top view in FIG. 3 of the drawings and in side view in FIG. 2 of the drawings or it may be different to accommodate a different machine. Again, it will be observed that bracket 36 is attached through bolt 27 to the right mounting block 24 on the right side of spout 18. As with left bracket 26, the right bracket 36 also has a right journal housing 38 which has a top pin aperture 39 and a lower pin aperture 41 aligned along a common axis perpendicular to the pour axis 34. As described in connection with left bracket 26, the right bracket likewise is adapted to engage a shaft within the elongated opening 42 in order to accommodate a shaft 46 attached to a casting machine. Again it is noted that only one bracket is necessary for mounting the ladle 11. Further a variety of brackets may be fused to attach the ladle 11 to various casting machines.

An alternate embodiment of the method of attaching ladle 11 to a casting machine is illustrated in connection with the right journal housing 38. It is noted that a link or arm which is part of a casting machine is attached to shaft 46 in order to connect the ladle 11 to a casting machine. Again, however, a pin is inserted through the shaft 46 when it is aligned with apertures 39 and 41 in order to secure the shaft 46 to the bracket 36 and thus attach the entire assembly to a casting machine. The link 43 may be connected to the shaft by bolts 44.

Of particular note is that brackets 26 and 36 may be located on either side of the ladle 11 or may be mirror images. As an alternative, however, it is noted that the individual brackets 26 and 36 because of the manner of attachment on left blocks 23 and right blocks 24 may be altered in order to accommodate machines of different manufacture. Accordingly, the ladle Il provides a uniquely adaptable ladle capable of being interchangeably mounted either on a left-hand or a right-hand machine but also the ladle is easily adaptable to mounting brackets of different types due to the mounting feature on the ladle.

Another feature of this invention relates to the positioning of the brackets 26 and 36 so that the axes of the longitudinal openings 31 and 42 of the respective brackets lies along a common pouring axis 34 which also falls through the inside surface 47 of the lip 22. This feature will be apparent by reference to FIG. 1 of the drawings where it is noted that pour axis 34 lies on the axis of the shaft 32 as well as the axis of the shaft 46. The pour axis 34 lies directly on the inside surface 47 of the spout lip 22. Further, an additional feature of the ladle is illustrated in FIGS. 2 and 3 of the drawings where it is likewise noted that the spout 18 terminates exactly at the axis 34. It is noted that axis 34 therefore not only is the axis of the edge of the inside surface 47 of the spout 18 but it also acts as the location of the termination of the spout 18. This particular feature insures that control of the molten metal as it is being poured from the ladle 11 is known and controllable with a variety of different machines whether the ladle 11 is employed in connection with a left-hand or a right-hand mounted machine.

Accordingly, the ladle 11 can be employed with a wide variety of casting machines employing brackets which can be pre-machined to attach the ladle to a variety of machines and yet maintain precise control of the location pour characteristics and rate of flow of the stream of molten metal exiting the ladle through the spout 22.

The above description is merely illustrative of the principles of the invention and many variations can be provided which fall within the spirit and scope of the invention. As an example, the ladle 11 may be formed from a variety of materials including cast iron, sheet iron and other materials. Likewise, the particular shape of the ladle can be adapted to accommodate the particular environment in which the ladle is to be used. Further, as illustrated, brackets of varying types may be employed. As an example, a bracket might be employed which is used to accommodate a square shaft rather than the cylindrical shaft 32 illustrated in the drawings. Nevertheless, the central or pouring axis of the device would remain the same.

What is claimed is:

1. A metal casting ladle used on a metal casting machine having either a left or right mounting connector for picking up and transferring by rotational motion about a horizontal pour axis a preselected amount of a flowable fluid metal to a casting mold which comprises:

a. a bowl having a wall with inner and outer surfaces and terminating in a top rim;

b. said bowl having a spout formed at a first side of said bowl said spout having a lip positioned below the said rim of said bowl and extending beyond said bowl to provide an outlet opening for metal to be poured from said bowl;

c. the wall of said bowl forming uniform curved inner and outer surfaces at the interface between said spout and the wall of said bowl to provide a uniform inner surface for the flow of molten metal;

d. a left mounting block connected to the outer surface of said wall at the interface with said spout;

e. a right mounting block connected to the outer surface of said wall at the interface with said spout and opposite the left mounting block;

f. said left and right mounting blocks providing independent and alternative mounting attachments for metal casting machines having either left or right mounting connector; and g. a bracket adapted to interconnect one of said mounting blocks of said ladle and said metal casting machine such that the pour axis falls through said lip.

2. A ladle in accordance with claim 1 in which said bracket has a journal housing, said journal housing providing an elongated opening for receiving a shaft and positioning the shaft along a pour axis extending through said lip, said journal housing having at least one pin aperture aligned along a common axis perpendicular to said pour axis and adapted to engage a pin for interlocking a shaft mounted in said journal housing to interlock said bracket to a shaft inserted in the journal housing along the pour axis.

3. A ladle in accordance with claim 1 in which a portion of said top rim in the area of said spout lies in a plane above the plane of the remainder of said top rim.

4. A ladle in accordance with claim 1 in which said spout terminates at a position coincidental with said pour axis.

5. A ladle in accordance with claim 2 in which said bracket is a left bracket adapted to be connected to said left mounting block.

6. A ladle in accordance with claim 2 in which said bracket is a right bracket adapted to be connected to said right mounting block.

7. A metal casting ladle for use on a metal casting machine having either a left or right mounting connector for picking up and transferring by rotational motion about a horizontal pour axis a preselected amount of a flowable fluid metal to a casting mold, the ladle comprising:

a. a bowl having a wall with inner and outer surfaces and terminating in a top rim;

b. said bowl having a spout formed at a first side of said bowl said spout having a lip positioned below the said rim of said bowl and extending beyond said bowl to provide an outlet opening for metal to be poured from said bowl;

c. the wall of said bowl forming uniform curved inner and outer surfaces at the interface between said spout and the wall of said bowl to provide a uniform inner surface for the flow of molten metal;

d. means for alternatively interconnecting said ladle and said metal casting machine to position said lip on said pour axis.

* * * * *